US005950696A

United States Patent [19]

Barsalou et al.

[11] Patent Number: 5,950,696

[45] Date of Patent: Sep. 14, 1999

[54] NEAT-LUBE

[76] Inventors: Yves R. Barsalou, 5744 Gagnon St., Azilda, Ontario, Canada, P0M 1B0; Michel M. Gauthier, 16 Beech St., Garson, Ontario, Canada, P3L 1B2

[21] Appl. No.: 09/076,454

[22] Filed: May 12, 1998

[30] Foreign Application Priority Data

Feb. 24, 1998 [CA] Canada ..... 2223697

[51] Int. Cl.[6] ..... B65B 1/04

[52] U.S. Cl. ..... 141/330; 141/329; 141/363; 141/375; 141/98; 222/81; 222/83.5; 222/88; 222/89

[58] Field of Search ..... 141/329, 330, 141/363, 375, 98; 222/81, 83.5, 85, 86, 88, 89; 184/1.5

[56] References Cited

U.S. PATENT DOCUMENTS

| | | | |
|---|---|---|---|
| 4,289,255 | 9/1981 | Strampe | 141/330 |
| 4,746,023 | 5/1988 | Belter | 277/237 R |
| 4,846,236 | 7/1989 | Deruntz et al. | 141/329 |
| 4,991,634 | 2/1991 | Tudek | 141/330 |
| 5,111,910 | 5/1992 | Sheppard, Jr. | 184/1.5 |
| 5,280,764 | 1/1994 | Levinrad et al. | 141/330 |

*Primary Examiner*—Henry J. Recla
*Assistant Examiner*—Timothy L. Maust

[57] ABSTRACT

A dispenser device for facilitating the gravity pouring of liquids from a necked container having an impervious sealing sheet over its opening, into a receptacle chamber, such as typically utilized on conventional containers for internal combustion engine lubricants, the device comprising a lower section having a centered, upwardly projecting wedge shaped protrusion terminating in a point adapted to pierce the sealing sheet when the container opening is passed onto the point, and an upper section formed so as to be seatably engaged on and within an opening to the chamber through which the liquid is to be poured, while maintaining the point in a somewhat centered position with respect to the opening and within the chamber.

2 Claims, 2 Drawing Sheets

NEAT-LUBE

BACKGROUND OF THE INVENTION

The present invention relates to a dispenser accessory to facilitate dispensing of pourable liquids from a conventional necked container, such as typically used for internal combustion engine lubricants wherein the same provides means of enabling the user to allow the sealing sheet to remain on the mouth of the said container thus eliminating spills.

Conventional oil containers typically utilize a sealing sheet adhesively and fixedly secure to the mouth of such containers. Consequently, oil filling requires initial puncturing of the said seal and subsequently positioning of the oil directed from the container through an oil fill entry port frequently resulting in spillage of the oil to and on the surface of the engine oil fill port.

Because of this problem, it is known in the prior art to provide special devices or inserts, between containers holding the liquids and receptacles receiving such containers in order to dispense the liquids therefrom.

The containers include, but are not limited to, oil containers. The dispensers or devices include, but are not limited to, oil containers. Examples of prior art oil fill structures accordingly may be found in U.S. Pat. No. 4,746,023 to Belter setting forth a seal structure that is puncturable within a tubular shell to permit insertion of oil line tube or nozzle into a port in the housing or receptacle of an internal combustion engine.

U.S. Pat. No. 5,111,910 to Sheppard et al., utilizing an insert within an oil fill tube which consist of a seal puncturing portion of the body, and a lid.

U.S. Pat. No. 5,280,764 to Levinrad, et al., which discloses a device enabling water containers to be dispensed gravitationally whilst maintaining seal on bottle mouth, until mounted on receptacle.

U.S. Pat. No. 4,846,236 to Deruntz, et al.,utilizing an insert in which a pointed taper pierces a sheet seal on which is attached to the mouth of a liquid container.

SUMMARY OF THE INVENTION

The present invention is a device for facilitating the pouring of liquid from a necked container having an impervious sealing sheet over its opening, into a receptacle chamber, such as typically utilized on conventional containers for internal combustion engine lubricants.

More particularly in accordance with the invention a dispenser device is provided for facilitating the gravity pouring of liquids from a necked container having an impervious sealing sheet over its opening, into a receptacle chamber, such as typically utilized on conventional containers for internal combustion engine lubricants, the device comprising a lower section having a centered, upwardly projecting wedge shaped protrusion terminating in a point adapted to pierce the sealing sheet when the container opening is passed onto the point, and an upper section formed so as to be seatably engaged on and within an opening to the chamber through which the liquid is to be poured, while maintaining the point in a somewhat centered position with respect to the opening and within the chamber.

The device of the present invention provides an insert for mounting not only to an oil fill tube, but to a plurality of oil fill receptacles while maintaining all the advantages of the inventions denoted in prior art while overcoming many of the disadvantages.

BRIEF DESCRIPTION OF THE DRAWINGS

These and other advantages of the invention will become apparent upon reading the following detailed description and upon referring to the drawings in which.

Figure 1:
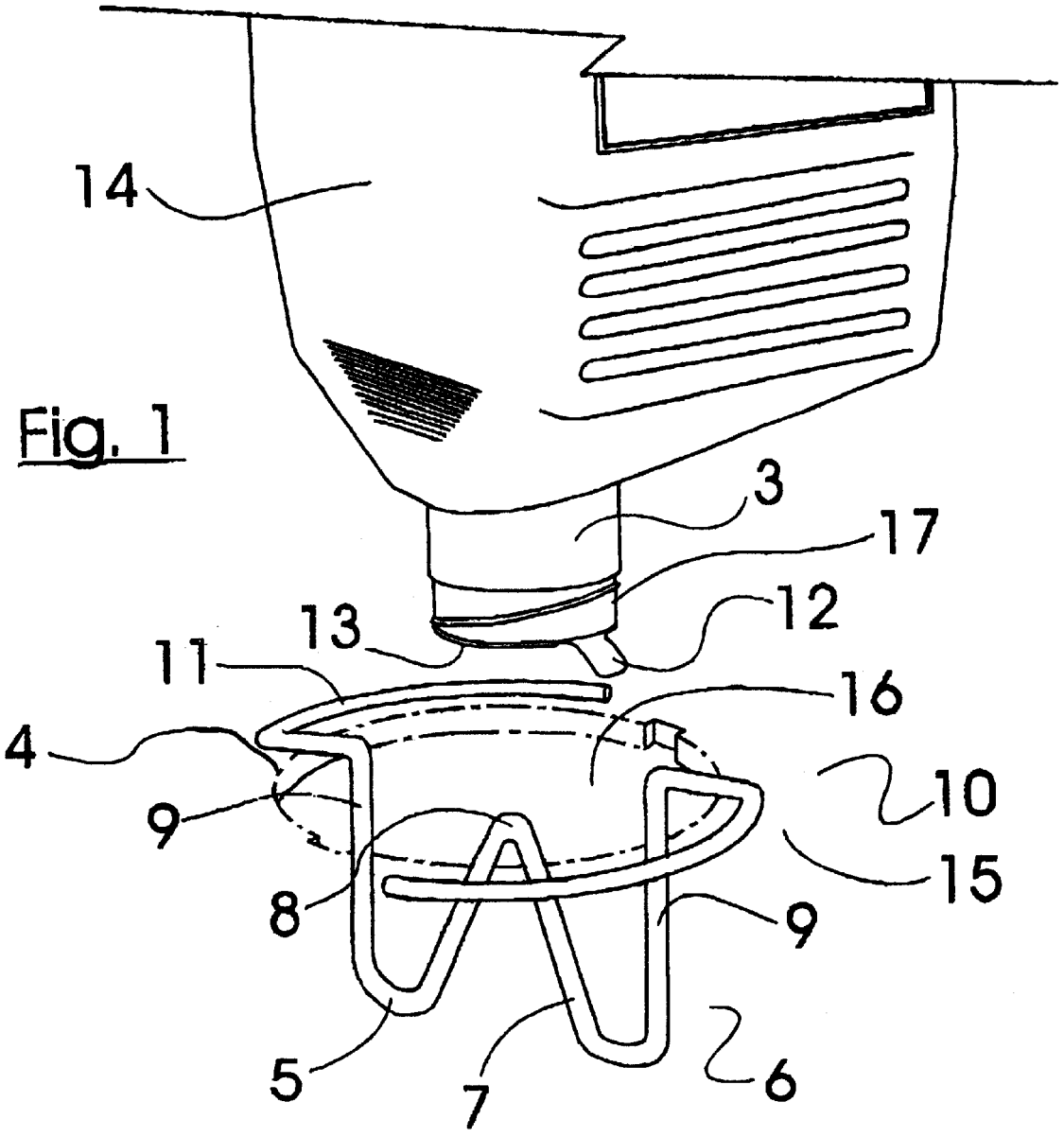
FIG. 1 is a partial view, in perspective, showing a dispenser device in accordance with the present invention in place in an oil entry port of an internal combustion engine, ready to receive an oil container.

While the invention will be described in conjunction with the illustrated embodiments, it will be understood that it is not intended to limit the invention to such embodiments. On the contrary, it is intended to cover all alternatives, modifications and equivalents as may be included within the spirit and scope of the invention as defined by the appended claims.

DESCRIPTION OF THE PREFERRED EMBODIMENT

In the following description, similar features in the drawings have been given similar reference numerals.

Figure 2:
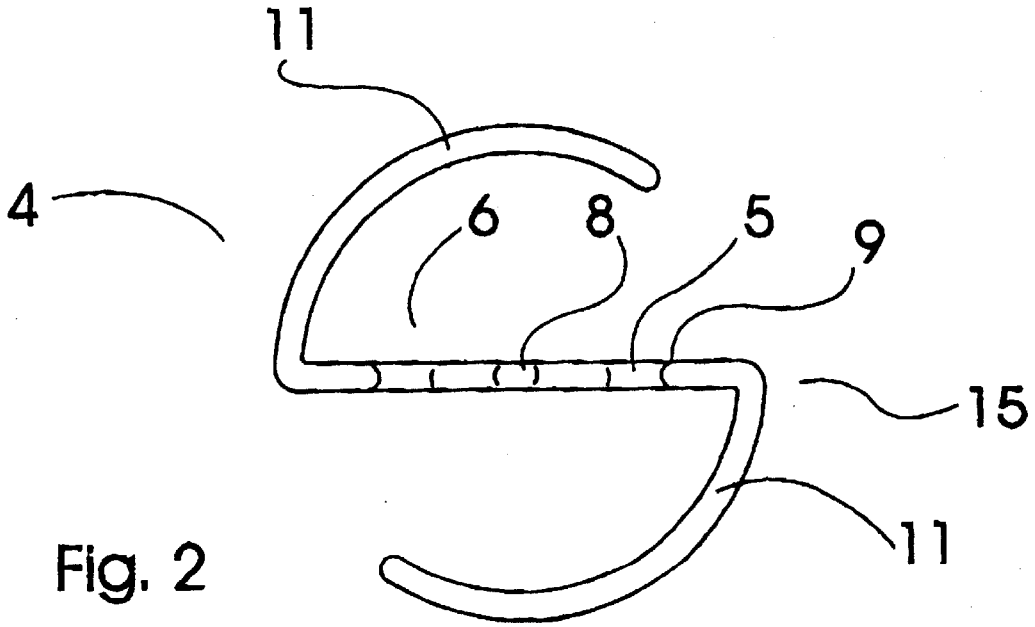
FIG. 2 is a top plan view of the device of FIG. 1.
Figure 3:
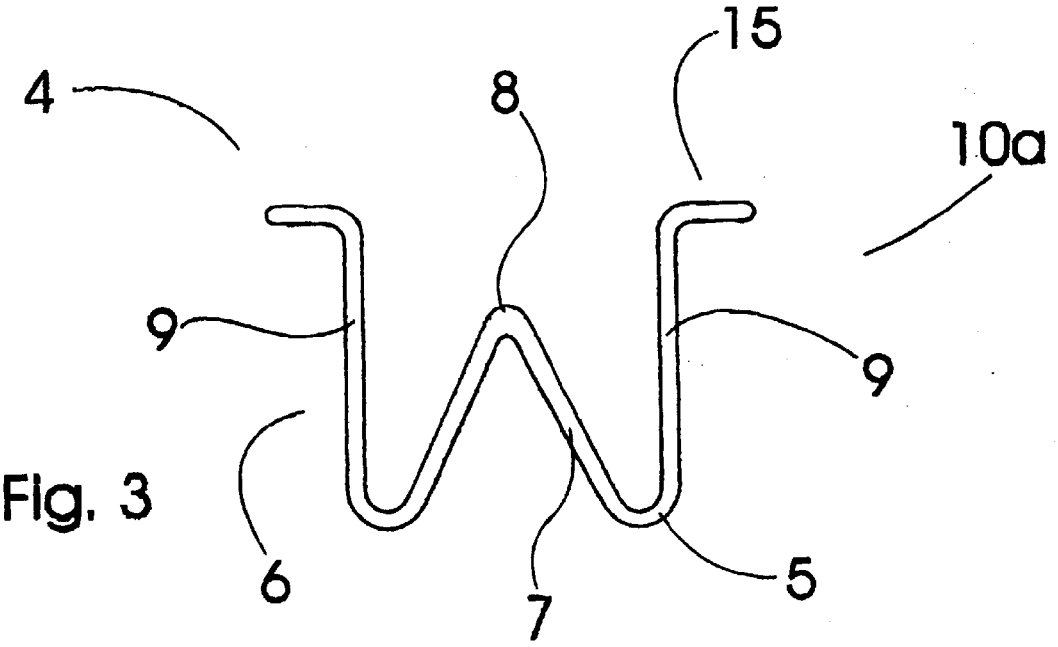
FIG. 3 is a side plan view of the device of FIG. 1.

With reference now to the drawings, and in particular to FIGS. 1 to 3 thereof, a new and improved oil fill dispenser device embodying the principles and concepts of the present invention and generally designated by the reference numerals 10 and 10*a*.

With reference first to FIG. 1, a perspective view of the device 10 simulated in use in conjunction with an oil entry port 4 an internal combustion engine.

More specifically, the oil fill insert 10 formed from a single piece of wire, comprising a lower section 6 having a centered, upwardly projecting wedge shaped protrusion 7 terminating in a point 8, adapted to pierce the sealing sheet 12 when the container opening 13 is passed onto the point 8, and an upper section 15 formed so as to be seatably engaged on and within an opening to the chamber 16 through which the liquid is to be poured, while maintaining the point 8 in a somewhat centered position with respect to the opening 4 and within the chamber 16.

Reference to FIGS. 2 and 3 discloses the form of the device or insert 10, beginning with the two extensions 11,which are shaped as such to each form approximately one quarter of the circumference in a circular horizontal manner, bent perpendicularly, on the horizontal, then again a downward perpendicular bend which forms the vertical extensions 9 which attach the top portion 15 and the lower portion 6. In reference with FIG. 3, denoting more specifically the lower section 6 which is attached to the said vertical arms 9 which provide positioning of an associated pouring spout 3 of a typically utilized oil container 14. Perpendicular bends 5 form the bottom of the vertical extension arms 9 bent towards the center of the device 8 as in FIG. 2. Now back to FIG. 3, more specifically to the point 8 at the lower section 6, denotes a series of bends which are formed as such to create a pointed wedge shaped 7 vertical protrusion which attach to the perpendicular lower bends 5 which are attached to the vertical extension arms 9.

In practice for the uses of this instant invention 10, refer now to FIG. 1 and note how the device 10 is inserted in and on the port 4 through which liquid is to be poured.

The port 4 may vary slightly in size without creating problems in the use of this said device 10. A necked container 14 having an adhesively and fixedly secured foil 12, may be poured into the engine oil receptacle 16 whilst not removing the said seal 12 when the container 14 is reversely and somewhat vertically lowered through this surface of the port 4 and its neck 3 and spout 17 within the dispenser or device 10, then the pointed wedge shaped protrusion 7 pierces the said seal 12 and the container 14 is rotated to any vertically axised direction, the liquid will gravitationally flow from the container 14 thus eliminating the frequently occurring spillage of oil on the engine.

Thus, it is apparent that there has been provided in accordance with the invention a device that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

The embodiments of the invention in which an exclusive property or privilege is claimed are defined as follows: What I/we claim as my/our invention:

1. A dispenser device for facilitating the gravity pouring of liquids from a necked container having an impervious sealing sheet over its opening, through a port of a receptacle chamber, such as typically utilized on conventional containers for internal combustion engine lubricants, said device constructed from resilient steel wire and comprising a lower section having a centered, upwardly projecting wedge shaped protrusion terminating in a point adapted to pierce the sealing sheet when the container opening is placed over the point, and an upper section formed so as to be seatably engaged on and within the port of the chamber through which the liquid is to be poured, while maintaining the point in a somewhat centered position with respect to the port, said upper section comprising extensions which, when in use, rest on surfaces of the receptacle chamber on opposite sides of the port and prevent sway of the said point, and sides, downwardly extending from the extensions, which are resiliently compressible so as to accommodate ports of varying size and act as guides for directing the neck of the container and its opening towards the said wedge shape protrusion terminating in a point.

2. A device according to claim 1 formed from a single continuous strand of steel wire.

* * * * *